United States Patent [19]

Falk

[11] 4,090,967

[45] May 23, 1978

[54] AQUEOUS WETTING AND FILM FORMING COMPOSITIONS

[75] Inventor: Robert A. Falk, New City, N.Y.

[73] Assignee: Ciba-Geigy Corporation, Ardsley, N.Y.

[21] Appl. No.: 642,272

[22] Filed: Dec. 19, 1975

[51] Int. Cl.[2] ..... A62C 1/00

[52] U.S. Cl. ..... 252/3; 252/8.05; 252/2

[58] Field of Search ..... 252/3, 8.05, 353, 355, 252/357, 2; 21/60.5 A

[56] References Cited

U.S. PATENT DOCUMENTS

| | | | |
|---|---|---|---|
| 3,258,423 | 6/1966 | Tuve et al. | 252/3 |
| 3,661,776 | 5/1972 | Fletcher et al. | 252/3 |
| 3,772,195 | 11/1973 | Francen | 252/8.05 |

OTHER PUBLICATIONS

Chemical Abstracts, vol. 48, 7396–7397.

*Primary Examiner*—Benjamin R. Padgett
*Assistant Examiner*—Josephine Lloyd
*Attorney, Agent, or Firm*—Edward McC. Roberts; Michael W. Glynn; Prabodh I. Almaula

[57] ABSTRACT

The disclosure relates to aqueous compositions which comprise water soluble fluorinated surfactant, fluorinated synergist, ionic non-fluorochemical surfactant, nonionic non-fluorochemical surfactant, electrolyte, and solvent. This composition is a concentrate which when diluted with water spreads on fuel surfaces suppressing vaporization. Because of this property the aqueous solutions of the above compositions are effective as agents for fire fighting.

10 Claims, No Drawings

AQUEOUS WETTING AND FILM FORMING COMPOSITIONS

BACKGROUND OF THE INVENTION

Conventional wetting agents can lower the surface tension attainable for an aqueous solution to between 25 and 27 dynes/cm. It has long been known that synergistic mixtures of surfactants can lower this minimum surface tension still further to between 22 and 24 dynes/cm (Miles et al. J. Phys. Chem. 48, 57 (1944)). Similarly, fluoroaliphatic surfactants, hereafter referred to as $R_f$ surfactants, can reduce the surface tension of an aqueous solution to between 15 and 20 dynes/cm. Similar synergistic effects can be attained with mixtures of $R_f$ surfactants and conventional fluorine-free surfactants as first shown in 1954 by Klevens and Raison (Klevens et al, J. Chem. Phys. 51, 1 (1954)) and Bernett and Zisman (Bernett et al, J. Phys. Chem. 65, 448 (1961)).

Aqueous solutions which have surface tensions below the critical surface tension of wetting of a hydrocarbon or polar solvent surface, will spread spontaneously on such a surface. As a practical utilization of this principle, Tuve et al disclosed in U.S. Pat. No. 3,258,423 that specific $R_f$-surfactants and $R_f$-surfactant mixtures alone or in combination with solvents and other additives could be used as efficient fire fighting agents. Based on the Tuve et al findings, numberous fire fighting agents containing different $R_f$-surfactants have been disclosed as for example U.S. Pat. Nos. 3,315,326, 3,475,333, 3,562,156, 3,655,555, 3,661,776, and 3,772,195; Brit. Pat. Nos. 1,070,289, 1,230,980, 1,245,124, 1,270,662, 1,280,508, 1,381,953; Ger. Pat. Nos. 2,136,424, 2,165,057, 2,240,263, 2,315,326; Can. Pat. Nos. 842,252, and pending U.S. Application Ser. No. 561,393.

Fire fighting agents containing $R_f$-surfactants act in two ways:

a. As foams, they are used as primary fire extinguishing agents.

b. As vapor sealants, they prevent the re-ignition of fuel and solvents.

It is this second property which makes fluorochemical fire fighting agents far superior to any other known fire fighting agent for fighting fuel and solvent fires.

These $R_f$-surfactant fire fighting agents are commonly known as AFFF (standing for Aqueous Film Forming Foams). AFFF agents act the way they do because the $R_f$-surfactants reduce the surface tension of aqueous solutions to such a degree that the solutions will wet and spread upon non-polar and water immiscible solvents even though such solvents are lighter than water; they form a fuel or solvent vapor barrier which will rapidly extinguish flames and prevent re-ignition and reflash. The criterion necessary to attain spontaneous spreading of two immiscible phases has been taught by Hardins et al *J. Am. Chem.* 44, 2665 (1922). The measure of the tendency for spontaneous spreading is defined by the spreading coefficient (SC) as follows:

$$SC = \delta a - \delta b - \delta i$$

where

SC = spreading coefficient $\delta a$ = surface tension of the lower liquid phase $\delta b$ = surface tension of the upper aqueous phase $\delta i$ = interfacial tension between the aqueous upper phase and lower liquid phase.

If the SC is positive, the surfactant solution should spread and film formation should occur. The greater the SC, the greater the spreading tendency. This requires the lowest possible aqueous surface tension and lowest interfacial tension, as is achieved with mixtures of certain $R_f$-surfactants(s) and classical hydrocarbon surfactant mixtures.

Commercial AFFF agents are primarily used today in so-called 6% and 3% proportioning systems 6% means that 6 parts of an AFFF agent and 94 parts of water (fresh sea, or brackish water) are mixed or proportioned and applied by conventional foam making equipment wherever needed. Similarly an AFFF agent for 3% proportioning is mixed in such a way that 3 parts of this agent and 97 parts of water are mixed and applied.

Today AFFF agents are used wherever the danger of fuel solvent fires exist and expecially where expensive equipment has to be protected. They can be applied in many ways, generally using conventional portable handline foam nozzles, but also by other techniques such as with oscillating turret foam nozzles, subsurface injection equipment (petroleum tank farms), fixed non-aspirating sprinkler systems (chemical process areas, refineries), underwing and overhead hangar deluge systems, inline proportioning systems (induction metering devices), or aerosol type dispension units as might be used in a home or vehicle. AFFF agents are recommended fire suppressants for Class A or Class B flammable solvent fires, particularly the latter. Properly used alone or in conjunction with dry chemical extinguishing agents (twin-systems) they generate a vapor-blanketing foam with remarkable securing action.

AFFF agents generally have set a new standard in the fighting of fuel fires and surpass by far any performance of the previously used protein foams. However, the performance of today's commercial AFFF agents is not the ultimate as desired by the industry. The very high cost of AFFF agents is limiting a wider use and it is, therefore, mandatory that more efficient AFFF agents which require less fluorochemicals to achieve the same effect are developed. Furthermore, it is essential that secondary properties of presently available AFFF agents be improved. Prior art AFFF compositions are deficient with respect to a number of important criteria which severely limit their performance. The subject AFFF agents show marked improvements in the following respects:

Seal Speed and Persistence — these important criteria equate to control, extinguishing, and burnback times of actual fire tests. The described AFFF agents spread rapidly on fuels and not only seal the surface from further volatilization and ignition, but maintain their excellent sealing capacity for long periods of time. The persistence of the seal with the subject compositions is considerably better than prior art formulations.

Preferred compositions spread rapidly and have a persistent seal even at lower than recommended use concentrations. At concentrations down to one-half the recommended dilutions, and even with sea water, which is generally a difficult diluent, seals are still attained rapidly and maintained considerably longer than by competitive AFFF agents. This built in safety factor for performance is vital when we consider how difficult it is to proportion precisely.

One must remember that in fire-fighting, lives are frequently at stake, and on stress situations the fire-fighter may err with regard to ideal proportioning of the concentrate. Even at one-half the designated dilution the subject compositions perform well.

Storage Stability — the subject AFFF concentrates and premix solutions in sea water and hard water (300 ppm or greater) maintain both clarity and foam expansion stability. No decrease is seen in performance after accelerated aging for over 40 days at 150° F). Prior art compsitions were noticeably inferior upon accelerated aging in that clarity could not be maintained, and the foam expansion of premixes generally decreased.

Fluorine Efficiency — substantial economics are realized because the subject AFFF compositions perform so well yet contain considerably less of the expensive fluorochemicals than do prior art formulations. Extremely low surface tensions and hence higher spreading coefficients, can be achieved with certain of the preferred AFFF compositions at very low fluorine levels.

Economics — the preferred compositions can be prepared from relatively cheap and synthetically accessible fluorochemicals. The preferred fluorochemicals are conventional $R_f$-surfactants, obtainable in extremely high yield by simple procedures adaptable to scale-up. The subject AFFF compositions are therefore economically competitive with available AFFF agents and may well permit the use of AFFF type firefighting compositions in hazardous application areas where lives and equipment can be protected but where their previous high price precluded their use. The AFFF agents of this invention also have: (a) a chloride content below 50 ppm so that the concentrate does not induce stress corrosion in stainless steel, and (b) such a high efficiency that instead of using 3 and 6% proportioning systems it is possible to use AFFF agents in 1% or lower proportioning systems. This means that 1 part of an AFFF agent can be blended or diluted with 99 parts of water. Such highly efficient concentrates are of importance because storage requirements of AFFF agents can be greatly reduced, or in the case where storage facilities exist, the capacity of available fire protection agent will be greatly increased. AFFF agents for 1% proportioning systems are of great importance therefore wherever storage capacity is limited such as on offshore oil drilling rigs, offshore atomic power stations, city fire trucks and so on. The performance expected from an AFFF agent today is in most countries regulated by the major users such as the military and the most important AFFF specifications are documented in the U.S. Navy Military Specification MIL-F-24385 and its subsequent amendments.

The novel AFFF agents described of this invention are in comparison with today's AFFF agents superior not only with regard to the primary performance characteristics such as control time, extinguishing time and burnback resistance but additionally, because of their very high efficiency offer the possibility of being used in 1% proportioning systems. Furthermore, they offer desirable secondary properties from the standpoint of ecology as well as economy.

Detailed Disclosure — The present invention is directed to aqueous film forming concentrate compositions for 1 to 6% proportioning, for extinguishing or preventing fires by suppressing the vaporization of flammable liquids, said composition comprising A. 0.5 to 25% by weight of a fluorinated surfactant,
B. 0.1 to 5% by weight of a fluorinated synergist,
C. 0.1 to 25% by weight of an ionic non-fluorochemical surfactant,
D. 0.1 to 40% by weight of a nonionic hydrocarbon surfactant,
E. 0 to 70% by weight of solvents,
F. 0 to 5% by weight of an electrolyte, and
G. water in the amount to make up the balance of 100%

Each component A to F may consist of a specific compound or a mixture of compounds.

The above composition is a concentrate which, as noted above, when diluted with water, forms a very effective fire fighting formulation by forming a foam which deposits a tough film over the surface of the flammable liquid which prevents its further vaporization and thus extinguishes the fire.

It is a preferred fire extinguishing agent for flammable solvent fires, particularly for hydrocarbons and polar solvents of low water solubility, in particular for:

Hydrocarbon Fuels — such as gasoline, heptane, toluene, hexane, Avgas, VMP naphtha, cyclohexane, turpentine, and benzene;

Polar Solvents of Low Water Solubility — such as butyl acetate, methyl isobutyl ketone, butanol, ethyl acetate, and Polar Solvents of High Water Solubility — such as methanol, acetone, isopropanol, methyl ethyl ketone, ethyl cellosolve and the like.

It may be used concomitantly or successively with flame suppressing dry chemical powders such as sodium or potassium bicarbonate, ammonium dihydrogen phosphate, $CO_2$ gas under pressure, or Purple K, as in so-called Twin-agent systems. A dry chemical to AFFF agent ratio would be from 10 to 30 lbs of dry chemical to 2 to 10 gallons AFFF agent at use concentration (i.e. after 0.5%, 1%, 3%, 6% or 12% proportioning). In a typical example 20 lbs of a dry chemical and 5 gals. of AFFF agent could be used. The composition of this invention could also be used in conjunction with hydrolyzed protein or fluoroprotein foams.

The foams of the instant invention do not disintegrate or otherwise adversely react with a dry powder such as Purple-K Powder (P-K-P). Purple-K Powder is a term used to designate a potassium bicarbonate fire extinguishing agent which is free-flowing and easily sprayed as a powder cloud on flammable liquid and other fires.

The concentrate is normally diluted with water by using a proportioning system such as, for example, a 3% or 6% proportioning system whereby 3 parts or 6 parts of the concentrate is admixed with 97 or 94 parts respectively of water. This highly diluted aqueous composition is then used to extinguish and secure the fire.

The fluorinated surfactants employed in the compositions of this invention as component (A) may be chosen from among anionic, amphoteric or cationic surfactants, but preferred are anionic $R_f$-surfactants represented by the formula $$\left[ R_f-R_6-SCH_2\underset{\underset{R_1}{|}}{CH}\overset{\overset{O}{\|}}{C}NH\underset{\underset{R_3}{|}}{\overset{\overset{R_2}{|}}{C}}-\underset{\underset{R_5}{|}}{\overset{\overset{R_4}{|}}{C}}-SO_3 \right]_n M$$

where $R_f$ is straight or branched chain perfluoroalkyl of 1 to 18 carbon atoms or perfluoroalkyl substituted by perfluoroalkoxy of 2 to 6 carbon atom; $R_1$ is hydrogen or lower alkyl; each of $R_2$, $R_4$ and $R_5$ is individually hydrogen or alkyl group of 1-12 carbons; $R_3$ is hydrogen, alkyl of 1 to 12 carbons, phenyl, tolyl, and pyridyl; $R_6$ is branched or straight chain alkylene of 1 to 12 carbon atoms, alkylenethioalkylene of 2 to 12 carbon atoms, alkyleneoxyalkylene of 2 to 12 carbon atoms or alkyleneiminoalkylene of 2 to 12 carbon atoms where the nitrogen atom is secondary or tertiary; M is hydrogen, a monovalent alkali metal, an alkaline earth metal, an organic base or ammonium; and *n* is an integer corresponding to the valency of M, i.e., 1 or 2. The above $R_f$-surfactant is disclosed in the copending U.S. Application Ser. No. 642,271 disclosure is incorporated herein by reference.

These preferred anionics are illustrated in Table 1 *a*, as are numerous other anionics useful purposes of this invention. A preferred group of amphoterics are disclosed more fully in the copending application of Karl F. Mueller, filed Jan. 3, 1975, Ser. No. 538,432 which is incorporated herein by reference, and are illustrated in Table 1*b*. Other amphoterics useful for purposes of this invention are also illustrated in Table 1*b*. Cationics useful for purposes of this invention are illustrated in Table 1*c*. Typically they are quaternized perfluoroalkanesulfonamidopolymethylene dialkylamines as described in U.S. Pat. No. 2,759,019.

The structures of the fluorinated synergists employed as component (B) may be chosen from compounds represented by the formula $$R_f-T_m-Z$$

where $R_f$ is as defined above; T is $R_6$ or $-R_6SCH_2CHR_1-$, *m* is an integer of 0 to 1, Z is one or more covalently bonded, preferably polar, groups comprising the following radicals: $-CONR_1R_2$, $-CN$, $-CONR_1COR_2$, $SO_2NR_1R_2$, $-SO_2NR_1R_7(OH)_n$, $-R_7(OH)_m$, $-R_7(O_2CR_1)_n$, $-CO_2R_1$, $-C(=NH)NR_1R_2$. $R_1$, $R_2$ and $R_6$ are as defined above. $R_7$ is a branched or straight chain alkylene of 1 to 12 carbon atoms, containing one or more polar groups. Preferred are compositions where Z is an amide or nitrile function. Illustrative examples of $R_f$-synergists which can be used in the compositions of this invention are given in Table 2 and also include:

$C_8F_{17}SO_2NH_2$
$C_8F_{17}SO_2N(CH_2CH_2OH)_2$
$C_8F_{17}SO_2N(C_2H_5)CH_2CHOHCH_2OH$
$R_fCH_2OH$
$R_fCH_2CHOHCH_2OH$
$R_fCHOHCH_2OH$

Also $(C_2F_5)_2(CF_3)C\text{-}CH_2CON(R)CH_2CH_2OH$ wherein R is H, $CH_3$, $C_2H_5$or $CH_2CH_2OH$ disclosed in Brit. 1,395,751; $R_f(CH_2CFR_1)_mCH_2CH_2CN$ wherein $R_1 = H$ or $F$, $m = 1 - 3$ as disclosed in copending application U.S. Ser. No. 442952, incorporated herein by reference; *and compounds* of the general structure: $R_f-CH_2CH_2-SO_xC_mH_{2m}A$ as described in Ger. Off. 2,344,889 wherein *x* is 1 or 2, $R_f$ is as described above, *m* is 1 to 3 and A is carboxylic ester, carboxamide or nitrile. The $R_f$-synergists are also generally useful in depressing the surface tension of any anionic, amphoteric, or cationic $R_f$-surfactant to exceedingly low values. Thus, $R_f$-surfactant/$R_f$-synergist systems have broad utility in improving the performance of $R_f$-surfactant system in a variety of applications other than the AFFF agent systems disclosed herein.

Component (C) is an ionic non-fluorochemical water soluble surfactant chosen from the anionic, cationic or amphoteric surfactants as represented in the tabulations contained in Rosen et al, *Systematic Analysis of surface-Active Agents,* Wiley-Interscience, New York, (2nd edition, 1972), pp, 485–544, which is incorporated herein by reference.

It may also include siloxane type surfactants of the types disclosed in U.S. Pat. No. 3,621,917, 3,677,347 and Brit. Pat. No. 1,381,953.

It is particularly convenient to use amphoteric or anionic fluorine-free surfactants because they are relatively insensitive to the effects of fluoroaliphatic surfactant structure or to the ionic concentration of the aqueous solution and furthermore, are available in a wide range of relative solubilities, making easy the selection of appropriate materials.

Preferred ionic non-fluorochemical surfactants are chosen with regard to their exhibiting an interfacial tension below 5 dynes/cm at concentrations of 0.01 –0.3% by weight, or exhibiting high foam expansions at their use concentration, or improving seal persistance. They must be thermally stable at practically useful application and storage temperatures, be acid and alkali resistance, be readily biodegradable and nontoxic, especially to aquatic life, be readily dispersible in water, be unaffected by hard water or sea water, be compatible with anionic or cationic systems, be tolerant of pH, and be readily available and inexpensive. Ideally they might also form protective coatings on materials of construction. A number of most preferred ionic non-fluorochemical surfactants are listed in Table 3.

In accordance with the classification scheme contained in Schwartz et al, *Surface Active agents,* Wiley-Interscience, N.Y., 1963, which is incorporated herein by reference, anionic and cationic surfactants are described primarily according to the nature of the solubilizing or hydrophilic group and secondarily according to the way in which the hydrophilic and hydrophobic groups are joined, i.e. directly or indirectly, and if indirectly according to the nature of the linkage.

Amphoteric surfactants are described as a distinct chemical category containing both anionic and cationic groups and exhibiting special behavior dependent on their isoelectric pH range, and their degree of charge separation.

Typical anionic surfactants include carboxylic acids, sulfuric esters, alkane sulfonic acids, alkylaromatic sulfonic acids, and compounds with other anionic hydrophilic functions, e.g., phosphates and phosphonic acids, thiosulfates, sulfinic acids, etc.

Preferred are carboxylic or sulfonic acids since they are hydrolytically stable and generally available. Illustrative examples of the anionic surfactants are

| | |
|---|---|
| $C_{11}H_{23}O(C_2H_4O)_{3.5}SO_3Na$ | (Sipon ES) |
| $C_{11}H_{23}OCH_2CH_2OSO_3Na$ | (Sipon ESY) |
| $C_{12}H_{25}OSO_3Na$ | (Duponol QC) |
| Disodium salt of alkyldiphenyl ether disulfonate | Dowfax 3B2 |
| Disodium salt of sulfocuccinic acid half ester derived from a $C_{10-12}$ ethoxylated alcohol | (Aerosol A-102) |
| Sodium Alpha olefin sulfonates | (Bioterge AS-40) |
| $C_{11}H_{23}CONH(CH_3)C_2H_4SO_3Na$ | (Igepon TC42) |
| $C_{11}H_{23}CON(CH_3)CH_2CO_2Na$ | (Sarkosyl NL-97) |

Also preferred are anionic surfactants obtained by the addition of reactive mercaptans to alkenylamidoalkane sulfonic acids, of the general structure $(R_6—SCH_2CHR_1CONHCR_2R_3CR_4R_5SO_3)_mM$ as described in greater detail in the copending application Ser. No. 642,270 which is incorporated by reference.

Typical cationic classes include amine salts, quaternary ammonium compounds, other nitrogenous bases, and non-nitrogenous bases, e.g. phosphonium, sulfonium, sulfoxonium; also the special case of amine oxides which may be considered cationic under acidic conditions.

Preferred are amine salts, quaternary ammonium compounds, and other nitrogenous bases on the basis of stability and general availability. Non-halide containing cationics are preferred from the standpoint of corrosion. Illustrative examples of the cationic surfactants are

| | |
|---|---|
| bis(2-hydroxyethyl)tallowamine oxide | (Aromox T/12) |
| dimethyl hydrogenated tallowamine oxide | (Aromox DMHT) |
| isostearylimidazolinium ethosulfate | (Monaquat ISIES) |
| cocoimidazolinium ethosulfate | (Monaquat CIES) |
| laurylimidazolinium ethosulfate | (Monaquat LIES) |
| $[C_{12}H_{25}OCH_2CH(CH)CH_2N(CH_3)CH_2CH_2OH)_2]+$ $CH_3SO_4$ | (Catanac 609) |
| $[C_{11}H_{23}CONH(CH_2)_3N(CH_3)_3]^+CH_3SO_4$ | (Catanac LS) |
| $[C_{17}H_{35}CONH(CH_2)_3N(CH_3)_2CH_2CH_2OH]^+NO_3-$ | (Catanac SN) |

The amphoteric non-fluorochemical surfactants include compounds which contain in the same molecule the following groups: amino and carboxy, amino and sulfuric ester, amino and alkane sulfonic acid, amino and aromatic sulfonic acid, miscellaneous combinations of basic and acidic groups, and the special case of aminimides.

Preferred non-fluorochemical amphoterics are those which contain amino and carboxy or sulfo groups.

Illustrative examples of the non-fluorochemical amphoteric surfactants are:

| | |
|---|---|
| coco fatty betaine $(CO_2^-)$ | (Velvetex BC) |
| cocoylamidoethyl hydroxyethyl carboxymethyl glycine betaine | (Velvetex CG) |
| cocoylamidoammonium sulfonic acid betaine | (Sulfobetaine CAW) |
| cetyl betaine (C-type) | (Product BCO) |
| a sulfonic acid betaine derivative | (Sulfobetaine DLH) |
| $C_{11}H_{23}CONN(CH_3)_2CHOHCH_3$ | (Aminimides) A56203 |
| $C_{11}H_{23}CONN(CH_3)_3$ | (A56201) |
| 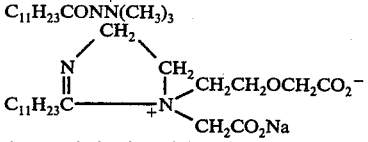 | (Miranol H2M-SF) |
| A coco-derivative of the above | (Miranol CM-SF) |
| Coco Betaine | (Lonzaine 12C) |
| $C_{12-14}H_{25-29}NH_2CH_2CH_2COO^-$ (triethanolammonium salt) | (Deriphat 170C) |
| 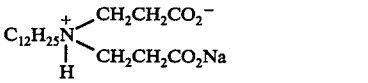 | (Deriphat 160C) |

and the amphoterics obtained by the addition of primary amines to alkenylamidoalkane sulfonic acids, of the general structure.

$R_7N\ [CH_2CHR_1CONHCR_2R_3CR_4R_5SO_3]_{M\Omega/n}$ as defined in the copending application Ser. no. 642,269, incorporated herein by reference. Component (C) surfactants also include silicones disclosed in U.S. Pat. No. 3,621,917 (anionic and amphoteric) U.S. pat. no. 3,677,347 (cationic) U.S. Pat. No. 3,655,555 and Brit. Pat. No. 1,381,953 (anionic, nonionic, or amphoteric). The disclosures of said patents are incorporated herein by reference.

A nonionic non-fluorochemical surfactant component (D) is incorporated in the aqueous fire compositions primarily as a stabilizer and solubilizer for the compositions particularly when they are diluted with hard water or sea water. The nonionics are chosen primarily on tghe basis of their hydrolytic and chemical stability, solubilization and emulsification characteristics (e.g. measured by HLB-hydrophilic-lipophilic balance), cloud point in high salt concentrations, toxicity, and biodegradation behavior. Secondarily, they are chosen with regard to foam expansion, foam viscosity, foam drainage, surface tension, interfacial tension and wetting characteristics.

Typical classes of nonionic surfactants useful in this invention include polyoxethylene derivatives of alkylphenols, linear or branched alcohols, fatty acids, mercaptans, alkylamines, alkylamides, acetylenic glycols, phosphorus compounds, glucosides, fats and oils. Other nonionics are amine oxides, phosphine oxides and nonionics derived from block polymers containing polyoxyethylene and/or polyoxypropylene units.

Preferred are polyoxyethylene derivatives of alkylphenols, linear or branched alcohols, glucosides and block polymers of polyoxyethylene and polyoxypropylene, the first two mentioned being most preferred.

Illustrative examples of the non-ionic non-fluorochemical surfactants are

| | |
|---|---|
| Octylphenol $(EO)_{9,10}$ | (Triton X-100) |
| Octylphenol $(EO)_{16}$ | (Triton X-165) |
| Octylphenol $(EO)_{30}$ | (Triton X-305) |
| Nonylphenol $(EO)_{9,10}$ | (Triton N-101) |
| Nonylphenol $(EO)_{12,13}$ | (Triton N-128) |
| Lauryl ether $(EO)_{23}$ | (Brij 35) |
| Stearyl ether $(EO)_{10}$ | (Brij 76) |
| Sorbitan monolaurate $(EO)_{20}$ | (Tween 20) |
| Dodecylmercaptan $(EO)_{10}$ | (Tergitat 12-M-10) |
| Block copolymer of $(EO)_x(PO)_4$ | (Pluronic F-68) |
| Block copolymer | (Tetronic 904) |
| $C_{11}H_{23}CON(C_2H_4OH)_2$ | (Superamide L9) |
| $C_{12}H_{25}N(CH_3)_2O$ | (Ammonyx LO) |
| $C_{12}H_{25}N$ $(CH_2CH_2O)_xH$ $(CH_2CH_2O)_yH$ $x + y = 25$ | (Ethomeen C/25) |

NOTE: EO used above means ethylene oxide repeating unit. Preferred non-ionics are further illustrated in Table 4.

Component (E) is a solvent which acts as an antifreeze, a foam stabilizer or as a refractive index modifier, so that proportioning systems can be field calibrated. Actually, this is not a necessary component in the composition of this invention since very effective AFFF concentrates can be obtained in the absence of a solvent. However, even with the compositions of this invention it is often advantageous to employ a solvent especially if the AFFF concentrate will be stored in subfreezing temperatures, or refractometry requirements are to be met. Useful solvents are disclosed in U.S. Pat. No. 3,457,172; 3,422,011; and 3,579,446, and German Pat. No. 2,137,711.

Typical solvents are alcohols or ethers such as:

ethylene glycol monoalkyl ethers, diethylene glycol monoalkyl ethers, propylene glycol monoalkyl ethers, dipropylene glycol monoalkyl ethers, triethylene glycol monoalkyl ethers, 1-butoxythoxy-2-propanol, glycerine, diethyl carbitol, hexylene glycol, butanol, t-butanol, isobutanol, ethylene glycol and other low molecular weight alcohols such as ethanol or isopropanol wherein the alkyl groups contain 1-6 carbon atoms.

Preferred solvents are 1-butoxyethoxy-2-propanol, diethyleneglycol monobutyl ether, or hexylene glycol.

Component (F) is an electrolyte, typically a salt of a monovalent or polyvalent metal of Groups 1, 2, or 3, or organic base. The alkali metals particularly useful are sodium, potassium, and lithium, or the alkaline earth metals, especially magnesium, calcium, strontium, and zinc or aluminum. Organic bases might include ammonium, trialkylammonium, bis-ammonium salts or the like. The cations of the electrolyte are not critical, except that halides are not desireable from the standpoint of metal corrosion. Sulfates, bisulfates, phosphates, nitrates and the like are acceptable.

Preferred are polyvalent salts such as magnesium, sulfate, magnesium nitrate or strontium nitrate.

Still other components which may be present in the formula are:

Buffers whose nature is essentially non-restricted and which are exemplified by Sorensen's phosphate or McIlvaine's citrate buffers Corrosion inhibitors whose nature is non-restricted so long as they are compatible with the other formulation ingredients. They may be exemplified by ortho-phenylphenol Chelating agents whose nature is non-restricted, and which are exemplified by polyaminopolycarboxylic acids, ethylenediaminetetraacetic acid, citric acid, tartaric acid, nitrilotriacetic acid hydroxyethylethylenediaminetriacetic acid and salts thereof. These are particularly useful if the composition is sensitive to water hardness.

High molecular weight foam stabilizers such as polyethyleneglycol, hydroxypropyl cellulose, or polyvinylpyrrolidone.

The concentrates of this invention are effective fire fighting compositions over a wide range of pH, but generally such concentrates are adjusted to a pH of 6 to 9, and more preferably to a pH of 7 to 8.5, with a dilute acid or alkali. For such purpose may be employed organic or mineral acids such as acetic acid, oxalic acid, sulfuric acid, phosphoric acid and the like or metal hydroxides or amines such as sodium or potassium hydroxides, triethanolamine, tetramethylammonium hydroxide and the like.

As mentioned above, the compositions of this invention are concentrates which must be diluted with water before they are employed as fire fighting agents. Although at the present time the most practical, and therefore preferred, concentrations of said composition in water are 3% and 6% because of the availability of fire fighting equipment which can automatically admix the concentrate with water in such proportions, there is no reason why the concentrate could not be employed in lower concentrations of from 0.5% to 3% or in higher concentrations of from 6% to 12%. It is simply a matter of convenience, the nature of fire and the desired effectiveness in extinguishing the flames.

An aqueous AFFF concentrate composition which would be very useful in a 6% proportioning system comprises A. 1 to 3.5% by weight of fluorinated surfactant,
B. 0.1 to 2.0% by weight of fluorinated synergist,
C. 0.1 to 5.0% by weight of ionic non-fluorochemical surfactant,
D. 0.1 to 4.0% by weight of nonionic hydrocarbon surfactant,
E. 0 to 25.0% by weight of solvent,
F. 0 to 2.0% by weight of electrolyte, and
G) water in the amount to make up the balance of 100%.

Each component A to F may consist of a specific compound or mixtures of compounds.

The subject composition can be also readily dispersed from an aerosol-type container by employing a conventional inert propellant such as Freon 11, 12, 22 or C-318, $N_2O$, $N_2$ or air. Expansion volumes as high as 50 based on the ratio of air to liquid are attainable.

The most important elements of the AFFF system of this invention are components (A), the fluorinated surfactant and component (B), the $R_f$-synergist. Preferred are anionic $R_f$-surfactants of Types A1 - A10, and A13 as described in Table 1a, which are disclosed in copending U.S. application Serial No. 642,271. Preferred too are $R_f$-synergists of types B1-B18, which are disclosed in part in U.S. Pat. No. 3,172,910, and which are otherwise disclosed herein.

The preferred anionic $R_f$-surfactants, particularly in the presence of polyvalent metal ions, reduce the surface tension of the aqueous concentrate to about 20 dynes/cm. They act as solubilizers for the $R_f$-synergists, which further depress the surface tension sufficiently that the solutions spontaneously and rapidly spread on fuel surfaces. The $R_f$-synergists are usually present in lower concentration then the $R_f$-surfactants and since they are polar, yet non-ionized, contribute significantly to the excellent compatibility of the subject compositions in hard water, sea water, and with ionic AFFF ingredients necessarily present.

The ionic (or amphoteric) non fluorochemical surfactants (Component C) have several functions. They act as interfacial tension depressants, reducing the interfacial tension of the aqueous $R_f$-surfactant/$R_f$-synergist solutions from interfacial tensions as high as 20 dynes/cm to interfacial tensions as low as 0.1 dyne/cm; act as foaming agents so that by varying the amount and proportions of component (C) cosurfactant, it is possible to vary the foam expansion of the novel AFFF agent; act to promote seal persistance. By arranging the amounts and proportions of component (C) cosurfactant it is possible to a) depress the interfacial tension, b) optimize foam expansion, and c) improve seal persistance.

The nonionic hydrocarbon surfactants component (D) in the novel AFFF agent also have a multiple function by acting as solubilizing agents for the $R_f$-surfactants (Component A) and $R_f$-synergists (Component B) having poor solubility characteristics. They further act as stabilizing agents, especially of AFFF agent sea water premixes, influence the AFFF agent foam stability and foam drainage time, and influence the viscosity of AFFF agents, which is very critical especially in the case of 1% proportioning systems.

Solvents (Component E) are used similarly as solubilizing agents for $R_f$-surfactants, but also act as foam stabilizers, serve as refractive index modifiers to permit field calibration of proportioning systems, reduce the viscosity of highly concentrated AFFF agents, and act as anti-freeze.

Electrolytes (Component F) generally improve the surface tensions attainable with the subject formulations; they also improve compatibility with hard water. Whereas commercial 6% proportioning AFFF agents have high solvent contents of greater than 15%, this invention also teaches the preparation of comparable formulations with excellent performance at low solvent contents.

Some of the solvents present in the formulated AFFF agents are only present because they are carried into the product from the $R_f$-surfactant synthesis. As mentioned before other additives in the novel AFFF agent might be advantageous such as:

Corrosion inhibitors (for instance in the case where aqueous AFFF premixes are stored for several years in uncoated aluminum cans).

Chelating agents (if premixes of AFFF agents and very hard water are stored for longer periods of time).

Buffer systems (if a certain pH level has to be maintained for a long period of time).

Anti-freezes (if AFFF agents are to be stored and used at sub-freezing temperatures).

Polymeric thickening agents (if higher viscosities of AFFF agent – water premixes are desired because of certain proportioning system requirements), and so on.

Today's commercial AFFF agents are only capable of use on 6 and 3% proportioning systems. The composition of the instant AFFF agents and the ranges of the amounts of the different active ingredients in these novel AFF agents can be expressed for 0.5 to 12% proportioning systems. If the concentration in a composition for 6% proportioning is doubled then such a concentrate can be used for a 3% proportioning system. Similarly if the concentration of such a 6% proportioning system is increased by a factor of 6 then it can be used as a 1% proportioning system. As comparative data in the experimental part will show it is possible to make such 1% proportioning systems primarily:

A. Because of the higher efficiency of the novel $R_f$-surfactants used and the smaller amounts therefore needed.

B. Because of the rather low amounts of solvents required in the new AFFF agents to achieve foam expansion ratios as specified by the military.

In the examples, references are made to specifications used by the industry and primarily the military and to proprietary tests to evaluate the efficiency of the claimed compositions. More specifically, the examples refer to the following specifications:

Surface Tension and Interfacial Tension — ASTM D-1331-56

Freezing Point — ASTM D-1177-65 pH — ASTM D-1172

Sealability Test

Objective: To measure the ability of a fluorochemical AFFF formulation (at the end use concentration) to form a film across, and seal a cyclohexane surface.

Procedure: Ten mls of cyclohexane is pipetted into a 48 mm evaporating dish in the evaporometer cell. Helium flowing at 1000 cc per minute flushes the cyclohexane vapors from the cell through a 3 cm IR gas cell mounted on a PE 257 infrared spectrophotometer (a recording infrared spectrophotometer with time drive capability). The IR absorbance of the gas stream in the region of 2850 $cm^{-1}$ is continuously monitored as solutions of formulations are infused onto the surface. Formulations are infused onto the cyclohexane surface at a rate of 0.17 ml per minute using a syringe pump driven 1cc tuberculin syringe fitted with a 13 cm 22 gauge needle, whose needle is just touching the cyclohexane surface.

Once the absorbance for "unsealed" cyclohexane is established, the syringe pump is started. Time zero is when the very first drop of formulation solution hits the surface. The time of 50% seal, percent seal at 30 seconds and 1–4 minutes are recorded. Time to 50% seal relates well to film speed (see below), percent seal in 30 seconds and 1–4 minutes relate well to the efficiency and effectiveness of the film as a vapor barrier (film persistence).

Film Speed Test

Objective: To determine the speed with which an AFFF film spreads across a cyclohexane surface.

Procedure: Fill a 6 cm aluminum dish one-half full with cyclohexane. Fill a 50ml syringe with a 6% solution of the test solution. Inject 50 ml of the solution as rapidly and carefully as possible down the wall of the dish such that the solution flows gently onto the cyclohexane surface. Cover the dish with an inverted Petri dish. Start the timer at the end of the injection. Observe the film spreading across the surface and stop the timer the moment the film completely covers the surface and record the time.

Fire Tests

The most critical test of the subject compositions is actual fire tests. The detailed procedures for such tests on 28, 50, and 1260 square foot fires are set forth in the U.S. Navy Specification MIL-F-24385 and its Amendments.

Procedure: Premixes of the compositions of this invention are prepared from 0.5 to 12% proportioning concentrates with tap or sea water, or the AFFF agent is proportioned by means of an in-line proportioning system. The test formulation in any event is applied at an appropriate use concentration.

The efficacy of the compositions of the present invention to extinguish hydrocarbon fires was proven repeatedly and reproducibly on 28-square foot (2.60 sq. m) gasoline fires as well as on 1260-square foot (117.05 sq. m) fires conducted on a 40 feet (12.19 m) in diameter circular pad. The tests were frequently conducted under severe environmental conditions with wind speeds up to 10 miles (16 km) per hour and under prevailing summer temperatures to 95° F (35° C). The fire performance tests and subsidiary tests — foamability, film formation, sealability, film speed, viscosity, drainage time, spreading coefficient, and stability, all confirmed that the compositions of this invention performed better than prior art AFFF compositions.

The most important criteria in determining the effectiveness of a fire fighting composition are:

1. Control Time — The time to bring the fire under control or secure it after a fire fighting agent has been applied.

2. Extinguishing Time — The time from the initial application to the point when the fire is completely extinguished.

3. Burn-Back Time — The time from the point when the flame has been completely extinguished to the time when the hydrocarbon liquid reignites when the surface is subjected to an open flame.

4. Summation of % Fire Extinguished — When 50 or 1260 square foot (4.645 or 117.05 sq. m.) fires are extinguished the total of the "percent of fire extinguished" values are recorded at 10, 20, 30 and 40 second intervals. Present specification for 50 square foot (4.645 sq. m.) require the "Summation" to fires be 225 or greater, for 1,260 square foot fires (117.05 sq. m.) 285 or greater.

28-Square-Foot Fire Test

This test was conducted in a level circular pan 6 feet (1.83 m) in diameter (28 square feet — 2.60 square meters), fabricated from ¼-inch (0.635 cm) thick steel and having sides 5 inches (12.70 cm) high, resulting in a freeboard of approximately 2½ inches (6.35 cm) during tests. The pan was without leaks so as to contain gasoline on a substrate of water. The water depth was held to a minimum, and used only to ensure complete coverage of the pan with fuel. The nozzle used for applying agent had a flow rate of 2.0 gallons per (g.p.m.) (7.57 l per minute) at 100 pounds per square inch (p.s.i.) (7.03 kg/sq. cm) pressure. The outlet was modified by a "wing tip" spreader having a ⅛-inch (3,175 mm) wide circular arc orifice 1⅞ inches (4.76 cm) long.

The premix solution in fresh water or sea water was at 70° +- 10° F (21° C +- 5.5° C). The extinguishing agent consisted of a 6-percent proportioning concentrate or its equivalent in fresh water or sea water and the fuel charge was 10 gallons (37.85 l ) of gasoline. The complete fuel charge was dumped into the diked area within a 60-second time period and the fuel was ignited within 60 seconds after completion of fueling and permitted to burn freely for 15 seconds before the application of the extinguishing agent. The fire was extinguished as rapidly as possible by maintaining the nozzle 3½ to 4 feet above the ground and angled upward at a distance that permitted the closest edge of the foam pattern to fall on the nearest edge of the fire. When the fire was extinguished, the time-for-extinguishment was recorded continuing distribution of the agent over the test area until exactly 3 gallons (11.36 l) of premix has been applied (90-second application time).

The burnback test was started whin 30 second after the 90-second solution application. A weighted 1-foot (30.48 cm) diameter pan having 2-inch (5.08 cm) side walls and charged with 1 quart (0.946 l) of gasoline was placed in the center of the area. The fuel in the pan was ignited just prior to placement. Burnback time commenced at the time of this placement and terminated when 25 percent of the fuel area (7 square feet — 0.65 sq. meter), (36-inch diameter — 232.26 sq. cm), originally covered with foam was aflame. After the large test pan area sustained burning, the small pan was removed.

1260-Square-Foot Fire Test

This test was conducted in a level circular area 40 feet in diameter (1260-square-feet — 117.0 sq. m). The water depth was the minimum required to ensure complete coverage of the diked area with fuel. The nozzle used for applying the agent was designated to discharge 50 g.p.m. (189.27 l per minute) at 100 p.s.i. (7.07 kg/sq.cm).

The solution in fresh water or sea water was at 70° +- 10° F (21° C +- 5.50° C) and contained 6.0 +- 0.1% of the composition of this invention. The fuel was 300 gallons (1135.6 l) of gasoline. No tests were conducted with wind speeds in excess of 10 miles (16 km) per hour. The complete fuel charge was dumped into the diked area as rapidly as possible. Before fueling for any test run, all extinguishing agent from the previous test run was removed from the diked area.

The fuel was ignited within 2 minutes after completion of fueling, and was permitted to burn freely for 15 seconds before the application of the extinguishing agent.

The fire was extinguished as rapidly as possible by maintaining the nozzle 3½ to 4 feet (1.07 to 1.22 m) above the ground and angled upward at a distance that permitted the closest edge of the foam pattern to fall on the nearest edge of the fire.

At least 85 percent of the fire was to be extinguished within 30 seconds, and the "percent of fire extinguished" values were recorded.

The examples presented below further demonstrate the instant invention but they are not intended to limit the invention in any way. The examples will also demonstrate:

1. the contribution of each component to the overall performance of the claimed AFFF concentrate, and
2. the superiority of the AFFF concentrate as compared to the prior art.

The pH of the compositions in the examples are generally in the range pH 7–8.5 unless otherwise mentioned.

EXPERIMENTAL ART

Tables 1 through 5 list $R_f$-surfactants (Component A), $R_f$-synergists (Component B), ionic or amphoteric nonfluorochemical surfactants (Component C), nonionic hydrocarbon surfactants (Component D), solvents (Component E) and electrolytes (Component F) which are used in the examples following the tables.

The commercially available surfactants used in the examples are:

FC-95, which is an alkali metal salt of a perfluoroalkylsulfonic acid.

FC-128, which is a perfluoroalkanesulfonamido alkylenemonocarboxylic acid salt as disclosed in U.S. Pat. No. 2,809,990.

FC-134, which is a cationic quaternary ammonium salt derived from a perfluoroalkanesulfonamido alkylenedialkylamine as disclosed in U.S. Pat. No. 2,759,019, e.g. $C_8F_{17}SO_2NHC_3H_6N(CH_3)_3I^-$ Zonyl FSA and FSP, anionics derived from linear perfluoroalkyl telomers.

Zonyl FSB, an amphoteric carboxylate derived from linear perfluoroalkyl telomers.

Zonyl FSC, a cationic quaternary ammonium salt derived from linear perfluoroalkyl telomers.

Monflor 31 and 32, anionics derived from branched tetrafluoroethylene oligomers as disclosed in GB Pat. No. 1,148,486.

Monflor 72, a cationic derived from branched tetrafluoroethylene oligomers as disclosed in DT Pat. No. 2,224,653.

Table 1a

Fluorinated Anionic Surfactants used in Examples 1 to 113

| $R_f$ Surfactant | Name | Formula | | | |
|---|---|---|---|---|---|
| A1 | 2-Methyl-2-(3-[1,1,2,2-tetrahydroperfluoroalkylthio]propionamide)-1-propanesulfonic acid, sodium salt[f] | $R_fCH_2CH_2SCH_2CH_2CONHC(CH_3)_2CH_2SO_3Na$ wherein: | %$C_6F_{13}$ | %$C_8F_{17}$ | %$C_{10}F_{21}$ |
| | | | 40 | 42 | 12 |

Table 1a-continued

Fluorinated Anionic Surfactants used in Examples 1 to 113

| $R_f$ Surfactant | Name | Formula | | | |
|---|---|---|---|---|---|
| A2 | as above | | 36 | 38 | 18 |
| A3 | as above | | 35 | 36 | 20 |
| A4 | as above | | 35 | 40 | 20 |
| A5 | as above | | 32 | 42 | 21 |
| A6 | as above | | 27 | 44 | 23 |
| A7 | as above | | 20 | 48 | 26 |
| A8 | as above, 45% | | 100 | | |
| A9 | as above, 45% | | | 100 | |
| A10 | as above, 100% | | | | 100 |
| A11[2] | 1,1,2,2-Tetrahydroperfluoro-alkylsulfonate, potassium salt | $R_fCH_2CH_2SO_3$ wherein: | 20 | 40 | 20 |
| A12[2] | Perfluoroalkanoic acid, potassium salt | $R_fCOOK$ | 32 | 62 | 6 |
| A13 | A8, magnesium salt | | 100 | | |
| A14 | FC-95[3a] | | | | |
| A15 | FC-128[3a] | | | | |
| A16 | Zonyl FSA[3b] | | | | |
| A17 | Zonyl FSP[3b] | | | | |
| A18 | Monflor 31[3c] | | | | |
| A19 | Monflor 32[3c] | | | | |
| A20 | | $C_8F_{17}SO_2N(C_2H_5)CH_2CO_2K$ | | | |
| A21 | | $C_8F_{17}SO_3K$ | | | |
| A22 | | $C_8F_{17}SO_2NHCH_2C_6H_4SO_3Na$ | | | |

[1]As discussed in co-pending application Serial No. 642,271, where $R_f$ is a mixture consisting principally of $C_6F_{13}$, $C_8F_{17}$, and $C_{10}F_{21}$ in the approximate ratio 2:2:1 or as stated. 35% solution in 17.5% hexylene glycol - 47.5% water or as otherwise stated.
[2]Approximate homolog distribution
[3]Commercial products of a) 3M, b) duPont, c) I.C.I.

Table 1b

Fluorinated Amphoteric Surfactants used in Examples 1 to 113

| $R_f$ Surfactant | Name or Formula | Formula | | |
|---|---|---|---|---|
| | | $\%C_6F_{13}$ | $\%C_8F_{17}$ | $\%C_{10}F_{21}$ |
| A23[1,2] | N-[3-(dimethylamino)propyl]-2 and 3-(1,1,2,2-tetrahydroperfluoroalkylthio) succinamic acid, 60% solids | 20 | 40 | 20 |
| A24[3] | Zonyl FSB | | | |
| A25 | $C_7F_{15}CONHC_3H_6N^+(CH_3)_2CH_2CH_2CO_2^-$ | | | |
| A26 | $C_6F_{13}SO_2N(CH_2CO_2^-)C_3H_6N^+(CH_3)_3$ | | | |
| A27 | $C_6F_{13}CH_2CH_2SCH_2CH_2N^+(CH_3)_2CH_2CO_2^-$ | | | |
| A28 | $C_8F_{17}C_2H_4CONH(CH_2)_3N^+(CH_3)_2CH_2CH_2CO_2^-$ | | | |
| A29 | $C_6F_{13}SO_2N(C_3H_6SO_3^-)C_6H_6N^+(CH_3)_2(C_2H_4OH)$ | | | |
| A30 | $C_8F_{17}CH_2CH(CO_2^-)N^+(CH_3)_3$ | | | |
| A31 | $C_6F_{13}SO_2N(CH_2CH_2CO_2^-)C_3H_6N^+(CH_3)_2CH_2CH_2OH$ | | | |

[1]As disclosed in U.S. Serial No. 538,432
[2]Approximate homolog distribution
[3]Commercial product of duPont Table 1c Fluorinated Cationic Surfactants used in Examples 1 to 113

| $R_f$ Surfactant | Name or Formula |
|---|---|
| A32 | $C_8F_{17}SO_2NHC_3H_6\overset{+}{N}(CH_3)_3\overset{-}{Cl}$ |
| A33 | $C_8F_{17}SO_2NHC_3H_6\overset{+}{N}(CH_3)_2C_2H_5\overset{-}{O}SO_2OC_2H_5$ |
| A34 | $C_8F_{17}SO_2NHC_3H_6\overset{+}{N}(CH_3)_3\overset{-}{I}$ |
| A35 | $C_7F_{15}CONHC_3H_6\overset{+}{N}(CH_3)_3\overset{-}{Cl}$ |
| A36 | $C_8F_{17}SO_2NHC_3H_6\overset{+}{N}(CH_3)_2CH_2C_6H_5\overset{-}{Cl}$ |
| A37 | $C_8F_{17}SO_2N(CH_3)C_3H_6\overset{+}{N}(CH_3)_3\overset{-}{I}$ |

Table 1c-continued

Fluorinated Cationic Surfactants used in Examples 1 to 113

| $R_f$ Surfactant | Name or Formula |
|---|---|
| A38 | 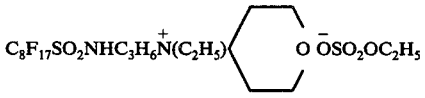 |
| A39 | $C_6F_{13}CH_2CH_2SCH_2CH_2\overset{+}{N}(CH_3)_3\overset{-}{I}$ |
| A40[1a] | FC-134 |
| A41[1b] | Zonyl FSC |
| A42[1c] | Monflor 72 |

[1]Commercial product of [a]3M, [b]duPont, [c]I.C.I.

Table 2

$R_f$ Synergists used in Examples 1 to 113

| $R_f$ Synergist | Name | Formula | | |
|---|---|---|---|---|
| | | $R_fCH_2CH_2SCH_2CH_2CONH_2$ wherein: | | |
| | | $\%C_6F_{13}$ | $\%C_8F_{17}$ | $\%C_{10}F_{21}$ |
| B1 | 3-[1,1,2,2-tetrahydroperfluoroal-kylthio]propionamide | 74 | 17 | 2 |
| B2 | as above | 73 | 19 | 2 |
| B3 | as above | 72 | 14 | 2 |
| B4 | as above | 71 | 23 | 2 |
| B5 | as above | 35 | 36 | 20 |
| B6 | as above | 100 | | |

Table 2-continued $R_f$-Synergists used in Examples 1 to 113

| $R_f$ Synergist | Name | Formula |
|---|---|---|
| B7 | as above | 100 |
| B8 | 3-[1,1,2,2-tetrahydroperfluoroalkylthio]propionitrile | $R_fCH_2CH_2SCH_2CH_2CN$ wherein: 40 42 12 |
| B9 | as above | 100 |
| B10 | as above | 100 |
| B11 | 2-methyl-3-[1,1,2,2-tetrahydroperfluoroalkylthio]propionamide | $R_fCH_2CH_2SCH_2CH(CH_3)CONH_2$ wherein: 40 42 12 |
| B12 | as above | 100 |
| B13 | N-[2-(2-methyl-4-oxopentyl)]3-[1,1,2,2-tetrahydroperfluoroalkylthio]propionamide | $R_fCH_2CH_2SCH_2CH_2CONHC(CH_3)_2CH_2COCH_3$ wherein: 40 42 12 |
| B14 | as above | 100 |
| B15 | hydroxymethylated derivative of B13 | 40 42 12 |
| B16 | as above | 100 |
| B17 | N-methyl-3-[1,1,2,2-tetrahydroperfluoroalkylthio]propionamide | $R_fCH_2CH_2SCH_2CH_2CONHCH_2OH$ wherein: 40 42 12 |
| B18 | as above | 100 |
| B19 | perfluoroalkanoamide | 100 ($C_7F_{15}CONH_2$) |
| B20 | perfluoroalkanonitrile | 100 ($C_7F_{15}CN$) |
| B21 | 1,1,2,2,3,3-hexahydroperfluoroalkylthioethanol | 100 ($R_fCH_2CH_2CH_2SCH_2CH_2OH$) |
| B22 | 1,1,2,2-tetrahydroperfluoroalkylthioethylacetate | 100 ($R_fCH_2CH_2SCH_2CH_2OCOCH_3$) |

Table 3

Ionic Surfactants used in Examples 1 to 113

| Ionic Surfactant | Name % Actives as Noted or ~100% | Formula or Commercial Name |
|---|---|---|
| C1 | partial sodium salt of N-alkyl β-iminodipropionic acid, 30% | wherein: R- $C_{12}H_{25}$(Deriphat 160C, General Mills) |
| C2 | as above | $C_8H_{17}$ |
| C3 | as above | $ROCH_2CH_2CH_2$, where R- is a 60/40 blend of $C_8H_{17}$ and $C_{10}H_{21}$ |
| C4 | disodium salt of N-alkyl-N,N-bis(2-propionamide-2-methyl-1-propane sulfonate[1] | $RN[CH_2CH_2CONHC(CH_3)_2CH_2SO_3Na]_2$ wherein: R- is $C_8H_{17}$ |
| C5 | as above | $C_{12}H_{25}$ |
| C6 | as above | Coco |
| C7 | as above | $C_{18}H_{37}$ |
| C8 | as above | $C_6H_{13}OCH_2CH_2CH_2$ |
| C9 | as above | $C_8H_{17}OCH_2CH_2CH_2$ |
| C10 | as above | $C_{10}H_{21}OCH_2CH_2CH_2$ |
| C11 | sodium salt of N-alkyl-N(2-propionamide-2-methyl-1-propane sulfonate | $RNHCH_2CH_2CONHC(CH_3)_2CH_2SO_3Na$ wherein: R- is $C_8H_{17}$ |
| C12 | as above | $C_{12}H_{25}$ |
| C13 | as above | Coco |
| C14 | as above | $C_{14}H_{29}$ |
| C15 | sodium salt of 2-methyl-2-(3-[alkylthio]-propionamido)-1-propane sulfonate[1] | $RSCH_2CH_2CONHC(CH_3)_2CH_2SO_3Na$ wherein: R- is $C_4H_9$ |
| C16 | as above | $C_6H_{13}$ |
| C17 | as above | $C_8H_{17}$ |
| C18 | as above | $C_{10}H_{21}$ |
| C19 | as above | $C_{12}H_{25}$ |
| C20 | N-lauryl, myristyl β-aminopropionic acid, 50% | Deriphat 170C, General Mills |
| C21 | cocoimidazolinium ethosulfate | Monaquat CIES, Mona Industries |
| C22 | trimethylamine laurimide | Aminimide A-56201, Ashland Chemical |
| C23 | | $C_{12}H_{25}SO_2N(CH_2CO_2^-)C_3H_6N^+(CH_3)_3$ |

[1]As disclosed in copending Serial No.

Table 4

Nonionic Surfactants used in Examples 1 to 113

| Nonionic Surfactant | Name - % Actives as Noted or ~100% |
|---|---|
| D1 | octylphenoxypolyethoxyethanol (12) 99% Triton X-102, Rohm & Hass |
| D2 | polyoxyethylene (23) lauryl ether Brij 35, I.C.I. |
| D3 | octylphenoxypolyethoxyethanol (16) -70% Triton X-165, Rohm & Haas |
| D4 | octylphenoxypolyethoxyethanol (10) -99% Triton X-100, Rohm & Haas |
| D5 | octylphenoxypolyethoxyethanol (30) -70% Triton X-305, Rohm & Haas |
| D6 | nonylphenoxypolyethoxyethanol (20) Igepal CO-850, GAF |
| D7 | nonylphenoxypolyethoxyethanol (30) -70% |

Table 4-continued

Nonionic Surfactants used in Examples 1 to 113

| Nonionic Surfactant | Name - % Actives as Noted or ~100% |
|---|---|
| D8 | Igepal CO-887, GAF branched alcohol ethoxylate (15) Renex 31, Atlas Chemical Industries |

Table 5

Solvents and Electrolytes used in Examples 1 to 113

| Solvent | Name |
|---|---|
| E1 | 1-butoxyethoxy-2-propanol |
| E2 | 2-methyl-2,4-pentanediol |

Table 5-continued

| Solvents and Electrolytes used in Examples 1 to 113 | |
|---|---|
| E3 | ethylene glycol |
| E4 | diethylene glycol monobutyl ether |
| Electrolytes | name |
| F | as specified in the examples |

EXAMPLES 1 to 4

AFFF agents having compositions as shown in Table 6 were compared using pure $C_6$, $C_8$, $C_{10}$ $R_f$-homologs. As is shown, the $R_f$-homolog content of the anionic $R_f$-surfactant is particularly important and higher ($C_{10}$) homologs are deleterious to film speed and foam expansion. As Example 4 shows, even at an increased % F the $C_{10}$ homolog slows the film speed and decreases the foam expansion.

Table 6

Comparison of Anionic $R_f$-Surfactant and its Homolog Content

| | | | | | | | | |
|---|---|---|---|---|---|---|---|---|
| Anionic $R_f$-Surfactants | | A1 | | | | | | Variable |
| $R_f$-Synergist | | B1 | | | | | | 0.72% (50% Solids) |
| Ionic Cosurfactant | | C1 | | | | | | 4.47% (30% Solids) |
| Other Ionic Cosurfactant | | C4 | | | | | | 2.92% (48% Solids) |
| Nonionic Cosurfactant | | D1 | | | | | | 0.75% |
| Solvent | | E1 | | | | | | 6.5% |
| Solvent | | E2 | | | | | | 5.5% |
| Magnesium Sulfate Heptahydrate | | | | | | | | 0.6% |
| Water | | | | | | | | Balance |
| Example Number | | | 1 | | 2 | | 3 | 4 |
| | $R_f$-homolog | | | | | | | |
| Anionic $R_f$-Surfactants | $C_6$ | A8 | 1.02 | | — | | — | 1.02 |
| | $C_8$ | A9 | 2.40 | | 3.28 | | 2.40 | 2.40 |
| | $C_{10}$ | A10 | — | | — | | 0.36 | 0.36 |
| Total % F in Formula | | | 0.87 | | 0.87 | | 0.87 | 1.05 |
| | | | tap | sea | tap | sea | tap | sea | tap | sea |
| Relative Film Speed[1] | | | 0.9 | 6.5 | 2.9 | 2.1 | 6.6 | 35.8 | 2.7 | 15 |
| Lab Expansion[2] | | | 6.1 | 6.5 | 5.8 | 5.5 | 5.3 | 5.1 | 5.7 | 5.8 |

[1]6% dilution in water of type specified
[2]relative values

EXAMPLES 5 to 7

AFFF agents having the compositions as shown in Table 7 were prepared with varying $R_f$-homolog distributions in both the anionic $R_f$-surfactant and the $R_f$-synergist. The percent fluorine contribution of each ingredient, and consequently the total percent fluorine, were identical. The comparative evaluation data show that if the same $R_f$-synergist is used, the anionic $R_f$-surfactant composition of A1 is preferably to A2. A3 and A5, which have an identical $R_f$-distribution, do not perform well in combination.

Table 7

Effect of Homolog Distribution on AFFF Performance

| | | | | |
|---|---|---|---|---|
| Anionic $R_f$-Surfactant | | | | Variable Homolog Distribution |
| $R_f$-Synergist | | | | Variable Homolog Distribution |
| Ionic Cosurfactant | C1 | | | 5.67% (30% Solids) |
| Nonionic Cosurfactant | D1 | | | 0.75% |
| Solvent | E1 | | | 6.5% |
| Solvent | E2 | | | 5.5% |
| Magnesium Sulfate Heptahydrate | | | | 0.6% |
| Water | | | | Balance |
| Example Number | | | 5 | 6 | 7 |
| Anionic $R_f$-Surfactant, 0.67% F | | | A3 | A2 | A1 |
| $R_f$-Synergist, 0.20% F | | | B5 | B4 | B4 |
| % F in formula | | | | all 0.87% F | |
| Lab Expansion[1] (sea) | | | 6.7 | 8.4 | 8.9 |
| Surface Tension (3% distilled) | | | 17.3 | 16.8 | 16.6 |
| Evaporometer Seal Speed, sec. (sea) | | | 35 | 15 | 13 |

[1]6% dilution in water specified

EXAMPLE 8 to 10

In Table 8, in which the compositions have identical fluorine content, it is clearly shown that the contribution of a particular anionic $R_f$-surfactant/$R_f$-synergist combination to performance is dependent upon their relative concentrations. An increased concentration of $R_f$-synergist relative to anionic $R_f$-surfactant markedly improves surface tension, and seal speed as measured on the evaporometer.

Table 8

Effect of Anionic $R_f$-Surfactant/$R_f$-Synergist Ratio

| | | | | | | |
|---|---|---|---|---|---|---|
| Anionic $R_f$-Surfactant Solution | | A1 | | | | Variable |
| $R_f$-Synergist Solution | | B1 | | | | Variable |
| Ionic Cosurfactant | | C1 | | | | 4.47% (30% Solids) |
| Other Ionic Cosurfactant | | C4 | | | | 2.92% (48% Solids) |
| Nonionic Cosurfactant | | D1 | | | | 0.75% |
| Solvent | | E1 | | | | 6.5% |
| Solvent | | E2 | | | | 5.5% |
| Magnesium Sulfate Heptahydrate | | | | | | 0.6% |
| Water | | | | | | Balance |
| Example Number | | | 8 | | 9 | 10 |
| Anionic $R_f$-Surfactant A1, 35% solids | | | 5.11 | | 4.45 | 3.79 |
| $R_f$-Synergist B1, 50% solids | | | 0.36 | | 0.72 | 1.08 |
| % F in formula | | | | all 0.87% F | | |
| | fresh | sea | fresh | sea | fresh | sea |
| Surface Tension[1] dynes/cm | 18.3 | 19.5 | 17.3 | 17.9 | 16.8 | 17.1 |
| Evaporometer Seal Speed, sec. | 11 | 17 | 10 | 14 | 8 | 11 |

[1]6% dilution in water of type specified

EXAMPLES 11 to 24

Tables 9 and 10 show the $R_f$-synergists are effective on both anionic and amphoteric $R_f$-surfactant type AFFF compositions. They may be used in the concentrate in the presence or absence of a divalent salt (e.g. $MgSO_4$), and will depress the surface tension at the use dilution to 16-18 dynes/cm. AFFF agents function by virtue of their low surface tensions and high spreading coefficients. Low surface tensions are mandatory to attain good fire extinguishing performance.

In Table 9 it is shown that a classical $R_f$-surfactant (A12) does not function as an $R_f$-synergist. $R_f$-synergists are not $R_f$-surfactants, since they are generally devoid of water solubility and cannot be used in themselves in formulation.

As is clearly shown in Table 10, in the absence of an $R_f$-synergist the $R_f$-surfactant/nonfluorochemical surfactant compositions do not have the requisite low surface tension, nor can they attain as high a spreading coefficient. Such formulations do not perform satisfactorily.

Table 9

Effect of $R_f$-Synergists in Anionic $R_f$-Surfactant Type AFFF Compositions

| | | |
|---|---|---|
| $R_f$-Surfactant | A1 | 4.45% |
| $R_f$-Synergists | Variable | 0.2% Fluorine |
| Ionic Cosurfactant | C1 | 5.67% |
| Nonionic Cosurfactant | D1 | 0.75% |
| Solvent | E1 | 6.5% |
| Solvent | E2 | 5.5% |
| Magnesium Sulfate Heptahydrate | | 0.6% |
| Water | | Balance |

| Example Number | $R_f$-Synergist | Surface Tension[1] |
|---|---|---|
| 11 | none | 20.0 |
| 12 | B1 | 16.8 |
| 13 | B8 | 16.8 |
| 14 | B19 | 18.6 |
| 15 | B20 | 18.2 |
| 16 | B21 | 16.9 |
| 17 | B22 | 18.2 |

Table 9-continued

| Effect of $R_f$-Synergists in Anionic $R_f$-Surfactant Type AFFF Compositions | | |
|---|---|---|
| 18 | (A12) | 20.0 |

[1]3% dilution in distilled water

Table 10

| Effect of $R_f$-Synergists in Amphoteric $R_f$-Surfactant Type AFFF Compositions | | |
|---|---|---|
| $R_f$-Surfactant | A23 | 2.47% |
| $R_f$-Synergist | Variable | 0.2% Fluorine |
| Ionic Cosurfactant | C1 | 9.0% |
| Nonionic Cosurfactant | D1 | 0.75% |
| Solvent | E1 | 6.5% |
| Solvent | E2 | 5.5% |
| Water | | Balance |
| Example Number | $R_f$-Synergist | Surface Tension[1] |
| 19 | none | 19.0 |
| 20 | B6 | 16.2 |
| 21 | B14 | 17.3 |
| 22[2] | B9 | 16.4 |
| 23[3] | B9 | 16.0 |
| 24[3] | B6 | 16.1 |

[1]at 3% dilution in distilled water
[2]with 5.67% C1
[3]with 3% C17

EXAMPLES 25 to 45

In Table 11 is shown the effect of various ionic cosurfactants upon foam expansion. The preferable candidates must not only give high expansions in both tap and sea water, but be compatible with hard water and sea water. An effective ionic cosurfactant generally contributes to a decreased interfacial tension and consequently a higher spreading coefficient. Other factors determining the choice of the ionic cosurfactant are described in succeeding tables.

Table 11

Effect of Ionic Cosurfactants on Foam Expansion

| Anionic $R_f$-Surfactant | A1 | 4.45% (35% Solids) |
|---|---|---|
| $R_f$-Synergist | B1 | 0.72% (50% Solids) |
| Ionic Cosurfactant | | Variable |
| Nonionic Cosurfactant | D1 | 0.75% |
| Solvent | E1 | 6.5% |
| Solvent | E2 | 5.5% |
| Water | | Balance |

| Example Number | Cosurfactant at 3% Actives | Foam Expansion[1,2] Tap | Foam Expansion[1,2] Sea |
|---|---|---|---|
| 25 | none | 5.5 | 3.6 |
| 26 | C1 | 11.0 | 10.8 |
| 27 | C2 | 4.9 | — |
| 28 | C3 | 9.2 | 9.9 |
| 29 | C4 | 5.8 | 5.8 |
| 30 | C5 | 7.3 | 6.0 |
| 31 | C6 | 6.4 | 6.0 |
| 32 | C7 | | insoluble |
| 33 | C8,C9,C10[3] | 7.4 | 5.9 |
| 34 | C11 | 3.6 | 4.0 |
| 35 | C12 | 7.4 | 6.6 |
| 36 | C13 | 6.4 | 5.7 |
| 37 | C14 | | insoluble |
| 38 | C15 | 4.9 | — |
| 39 | C16 | 6.8 | 7.5 |
| 40 | C17 | 9.3 | 9.0 |
| 41 | C18 | 8.6 | 7.2 |
| 42 | C19 | 6.4 | 5.1 |
| 43 | C20 | (hazy) 8.4 | — |
| 44 | C21 | (hazy) 2.4 | — |
| 45 | C22 | 7.9 | 80 |

[1]6% dilution in specified type of water
[2]relative values
[3]a mixture consisting predominantly of C9 and C10

EXAMPLES 46 to 53

AFFF compositions containing 3 percent by weight or variable ionic cosurfactants, but having otherwise identical compositions, as shown in Table, were evaulated using the *Evaporometer Device* for determining seal persistence. As the data in Table 12 show, within a homologous series ($C_4$-$C_{12}$) C15-C19, the surfactant with the most persistent 2 to 4 minute seal has the shortest hydrophobic chain. Otherwise stated, the surfactants with the least hydrocarbon solubility, which are generally least effective in depressing the interfacial tension, give the most persistent seals.

Cosurfactant C4 is a superior cosurfactant, giving an AFFF agent having a more persistent seal than FC-206. Cosurfactant C1 gives fair performance alone, but vastly improved performance in admixture with cosurfactant C4, for which see Table 13.

Table 12

Effect of Ionic Cosurfactants on Seal Persistance

| Anionic $R_f$-Surfactant | A1 | 4.54% (35% Solids) |
|---|---|---|
| $R_f$-Synergist | B1 | 0.72% (50% Solids) |
| Ionic Cosurfactant | Variable | 3.00% |
| Nonionic Cosurfactant | D1 | 0.75% |
| Solvent | E1 | 6.5% |
| Solvent | E2 | 5.5% |
| Magnesium Sulfate Heptahydrate | | 0.6% |
| Water | | Balance |

| Example Number | 46 | 47 | 48 | 49 | 50 | 51 | 52 | 53 |
|---|---|---|---|---|---|---|---|---|
| Ionic Cosurfactant | C19 | C18 | C17 | C16 | C15 | C4 | C1[2] | FC-206 |
| Evaporometer Seal[1] | | | | | | | | |
| Time to 50% Seal | 9 | 10 | 12 | 19 | 19 | 19 | 8 | 14 |
| Seal at 30 sec. | 84 | 94 | 71 | 86 | 89 | 95 | 98 | 98 |
| Seal at 2 min. | 27 | 57 | 50 | 81 | 95 | 99 | 80 | 96 |
| Seal at 4 min. | 16 | 20 | 24 | 43 | 95 | 98 | 40 | 91 |
| Surface Tension[1] dynes/cm | 16.7 | | 16.9 | | 16.4 | 16.4 | 17.3 | 16.2 |
| Interfacial Tension[1] dynes/cm | 1.6 | | 2.7 | | 3.5 | 4.0 | 2.1 | 2.8 |
| Spreading Coefficient[1] dynes/cm | 6.2 | | 4.9 | | 4.6 | 4.1 | 5.1 | 5.5 |

[1]6% dilution in tap water (300 ppm)
[2]at 1.7% in concentrate

EXAMPLES 54 to 59

Table 13 shows that mixtures of cosurfactants are frequently better than either cosurfactant alone. Such mixtures can retain the best foam expansion characteristics of one surfactant as well as have improved seal persistence due to the other. Conversely, too high a concentration of cosurfactants is frequently deleterious as shown in Example 59.

Table 13

| Effect of Mixtures of Ionic Cosurfactants on Overall Performance | | | |
|---|---|---|---|
| Anionic $R_f$-Surfactant | | A1 | 4.45% (35% Solids) |
| $R_f$-Synergist | | B1 | 0.72% (50% Solids) |
| Ionic Cosurfactants | | | Variable |
| Nonionic Cosurfactant | | D1 | 0.75% |
| Solvent | | E1 | 6.5% |
| Solvent | | E2 | 7.0% |
| Magnesium Sulfate Heptahydrate | | | 0.6% |
| Water | | | Balance |

| Example Number | | 54 | 55 | 56 | 57 | 58 | 59 |
|---|---|---|---|---|---|---|---|
| Ionic Cosurfactants | C1 | 5.7 | 5.7 | — | — | — | 3.3 |
| | C4 | — | 2.9 | 2.9 | 2.9 | — | 2.9 |
| | C17 | — | — | — | 3.0 | 3.0 | 3.0 |
| Lab Expansion[1,2] | | 5.7 | 5.9 | 4.8 | 6.5 | 5.7 | 7.0 |
| Evaporometer Seal[1] | | | | | | | |
| time to 50% seal | | 8 | 10 | 19 | 12 | 12 | 13 |
| seal at 30 sec. | | 98 | 99 | 95 | 95 | 71 | 85 |
| seal at 2 min. | | 80 | 100 | 99 | 75 | 50 | 47 |
| seal at 4 min. | | 40 | 90 | 98 | 43 | 24 | 25 |
| Spreading Coefficient[1] | | 5.1 | 5.1 | 4.1 | 4.1 | 4.9 | 2.9 |

[1]6% dilution in sea water
[2]relative values

EXAMPLES 60 to 67

The AFFF agents, having a composition as listed in Table 14, can be prepared and are identical with the exception that the nonionic aliphatic cosurfactants of Type D vary. All will show excellent compatibility with sea water, while the only sample not containing nonionic hydrocarbon surfactant will show a heavy precipitate if diluted with sea water.

Table 14

| Effect of Nonionic Cosurfactant | | |
|---|---|---|
| Anionic $R_f$-Surfactant | A1 | 4.45% |
| $R_f$-Synergist | B1 | 0.72% |
| Ionic Cosurfactant | C1 | 4.47% (30% Solids) |
| Other Ionic Cosurfactant | C4 | 2.92% (48% Solids) |
| Nonionic Cosurfactant | Variable | 0.75% |
| Solvent | E1 | 6.5% |
| Solvent | E2 | 5.5% |
| Magnesium Sulfate Heptahydrate | | 0.6% |
| Water | | Balance |

| Example Number | Nonionic Surfactant | Compatibility[1] with Sea Water |
|---|---|---|
| 60 | D2 | ↑ |
| 61 | D3 | |
| 62 | D4 | ↑ |
| 63 | D5 | good |
| 64 | D6 | ↓ |
| 65 | D7 | |
| 66 | D8 | ↓ |
| 67 | None | poor |

[1]6% dilution

EXAMPLES 68 to 73

In Table 15 the formulations were all designed to have a relatively high refractive index (necessary for monitoring shipboard proportioning systems), thus requiring total solvent contents of approximately 15-20%. The data shows that foam expansion is fundamentally related to the solvent type and content. Solvents preferable for improved expansion are E2 and E4. Since these solvents are most expensive the precise solvent composition is an important consideration in an AFFF product.

Table 15

| Effect of Solvent Type and Content on Foam Expansion | | |
|---|---|---|
| Anionic $R_f$-Surfactant | A1 | 4.45% (35% Solids) |
| $R_f$-Synergist | B1 | 0.72% (50% Solids) |
| Ionic Cosurfactant | C1 | 5.67% (30% Solids) |
| Nonionic Cosurfactant | D1 | 0.75% |
| Solvents | | Variable |
| Magnesium Sulfate Heptahydrate | | 0.6% |
| Water | | Balance |

Table 15-continued

| Effect of Solvent Type and Content on Foam Expansion | | | | | | |
|---|---|---|---|---|---|---|
| Example Number | 68 | 69 | 70 | 71 | 72 | 73 |
| Solvent E1, % | | | | | | 6.5 |
| E2, % | | | | | | 9.0 |
| E3, % | 20.4 | 12.5 | 9.5 | 4.5 | | |
| E4, % | | 6.5 | 9.0 | 13.2 | 17.5 | |
| Lab Expansion | 4.1 | 7.8 | 8.3 | 9.2 | 9.8 | 9.7 |
| Refractive Index, $n_D^{20}$ | all 1.3598 ± 0.0004 | | | | | |
| Solvent Price | increasing ——————→ | | | | | |

[1]6% dilution in fresh water; relative values only

EXAMPLES 74 to 76

AFFF agents having compositions as shown in Table 16 were evaluated and compared with a commercial AFFF agent, Light Water FC-200, in 28 sq. ft. fire tests. As the control time, extinguishing time, and burnback time data show, superior performance was achieved with the novel AFFF agents containing less than one half the amount of fluorine in the product. These results indicate the higher efficiency of the novel AFFF agents, and that the ionic cosurfactants can be varied over a wide range of concentration without sacrificing effectiveness in fire test performance.

Table 16

| Comparative Fire Test Data[1] of AFFF Agents | | |
|---|---|---|
| Anionic $R_f$-Surfactant | A1 | 4.45% |
| $R_f$-Synergist | B1 | 0.72% |
| Ionic Cosurfactant | | Variable |
| Other Ionic Cosurfactant | | Variable |
| Nonionic Cosurfactant | D1 | 0.75% |
| Solvent | E1 | 6.5% |
| Solvent | E2 | Variable |
| Magnesium Sulfate Heptahydrate | | 0.6% |
| Water | | Balance |

| Example Number | 74 | 75 | 76 | FC-200 |
|---|---|---|---|---|
| Ionic Cosurfactant C1 | 5.67 | 4.47 | 3.33 | |
| Other Ionic Cosurfactant C4 | — | 2.92 | 2.10 | |
| Solvent E2 | 5.5 | 7.0 | 7.0 | |
| % F in Formula | 0.87 | 0.87 | 0.87 | 2.10 |
| Control Time, sec. | 19 | 18 | 20 | 33 |
| Extinguishing Time, sec. | 40 | 28 | 32 | 52 |
| Burnback Time, min. | 5:30 | 6:50 | 6:35 | 5:30 |
| Foam Expansion | 7.0 | 7.0 | 7.0 | 7.0 |
| 25% Drain Time, min. | 3:30 | 4:10 | 4:00 | 5:03 |
| $n_D^{20}$ | 1.3553 | 1.3592 | 1.3582 | 1.3707 |

[1]6% dilution in sea water

EXAMPLES 77 to 78

AFFF agents having compositions as shown in Table 17 were compared in 28 sq. ft. fire tests. As the data show, the homolog distribution of both the anionic $R_f$-surfactant and the $R_f$-synergist are important criteria. The superior performance in Example 78 compares favorably with requirements established by the U.S. Navy in MIL-F-24385 and revisions.

Table 17

Comparative Fire Test Data[1] of AFFF Agents

| | | |
|---|---|---|
| Anionic $R_f$-Surfactant | Variable | |
| $R_f$-Synergist | Variable | |
| Ionic Cosurfactant | C1 | 4.47% |
| Other Ionic Cosurfactant | C4 | 2.82% |
| Nonionic Cosurfactant | D1 | 0.75% |
| Solvent | E1 | 6.5% |
| Solvent | E2 | 7.0% |
| Magnesium Sulfate Heptahydrate | | 0.6% |
| Water | | Balance |

| Example Number | | 77 | 78 | |
|---|---|---|---|---|
| | | sea | sea | fresh |
| Anionic $R_f$-Surfactant | A1 | | 4.45 | 4.45 |
| | A6 | 4.38 | | |
| $R_f$-Synergist | B1 | | 0.72 | 0.72 |
| | B2 | 0.76 | | |
| Control Time, sec. | | 19 | 18 | 17 |
| Extinguishing Time, sec. | 45 | 28 | 36 | |
| Burnback Time, min. | 4:50 | 6:50 | 7:15 | |
| Foam Expansion | 7.0 | 7.0 | 7.6 | 7.6 |
| 25% Drain Time, min. | 4:16 | 4:10 | 4:15 | |

6% in water as specified

EXAMPLE 79

Table 18 shows the marked superiority of the AFFF agent of Example 78, prepared in accordance with this patent, over the prior art. The performance is also shown in FIG. 1.

Not only does the film seal more rapidly and more completely than some prior art compositions, but this behavior is even manifest in one-half the suggested use concentration (at 3% dilution). The seal persistance is particularly striking and the film remains an efficient vapor barrier for prolonged periods of time. The behavior equates to improvements in control, extinguishing, and burnback times of actual fire tests.

Table 18

Comparison of Performance of Competitive AFFF Agents

| Example Number | 78 | | —[2] | | FC-206 | |
|---|---|---|---|---|---|---|
| Dilution[1] | 6 | 3 | 6 | 3 | 6 | 3 |
| Evaporometer Seal | | | | | | |
| Time to 50% Seal, sec. | 8 | 18 | 15 | 20 | 9 | 28 |
| Seal at 30 sec. | 99 | 98 | 98 | 96 | 99 | 60 |
| Seal at 1 min. | 100 | 100 | 99 | 99 | 99 | 100 |
| Seal at 2 min. | 100 | 100 | 99 | 99 | 50 | 83 |
| Seal at 3 min. | 95 | 98 | 98 | 99 | 50 | 66 |
| Seal at 4 min. | 90 | 90 | 85 | 96 | 50 | 60 |

[1]% dilution in sea water as specified

[2]Preferred Example 72 composition from co-pending U.S. Application Serial No. 561,393

EXAMPLE 80

An AFFF agent having the composition shown in Table 19 was tested as an aerosol dispensed AFFF agent upon 2B fires (Underwriters Laboratory designation). The result shows that the composition was more effective in extinguishing the fires in a shorter time than either of the commercially available agents, Light Water FC-200 or FC-206. Similar compositions can be prepared with other anionic $R_f$-surfactant/$R_f$-synergist combinations chosen from Tables 1 and 2 and with other buffers such as Sorensen's phosphate at pH 5.5, McIlvaine's citrate/phosphate at pH 5.5, and Walpole's acetate at pH 5.5.

Table 19

Composition and Evaluation of Aerosol Dispensed AFFF Agents

| Example Number | 80 | FC-206 | FC-200 |
|---|---|---|---|
| Anionic $R_f$-Surfactant Al, % as is | 4.1 | | |
| $R_f$-Synergist Bl, % as is | 0.6 | | |
| Ionic Cosurfactant Cl, % as is | 5.0 | | |
| Other Ionic Cosurfactant C21, % as is | 0.5 | | |
| Nonionic cosurfactant D1, % as is | 1.75 | | |
| Solvent E2[1] | 3.0 | | |
| Buffer Salts, Type Fl, % as is[1,3] | 0.2 | | |
| Surface Tension,[4] dynes/cm | 18.9 | 16.3 | 15.9 |
| Interfacial Tension,[4] dynes/cm | 1.8 | 4.5 | 4.0 |
| Spreading Coefficient,[4] dynes/cm | 3.8 | 3.8 | 4.7 |
| Fire Performance Characteristics[5] from Aerosol Can[2] on 2B[6] Fires at a 6% Dilution | | | |
| Discharge Duration, sec. | 55 | 51 | 58 |
| Foam Volume, liters | 8.7 | 8 | 8 |
| Control Time, sec. | 28.5 | 23 | 19 |
| Extinguishing Time, sec. | 43.5 | 59 | 74 |

[1]The % solvent content and % buffer salts are noted for the actual aerosol charge after dilution of the concentrate to a 6% dilution; the remainder is water

[2]The aerosol container is a standard 20 oz. can containing a 430 gram charge of AFFF agent and a 48 gram charge of Propellant 12

[3]Buffer salts Fl, Sorensen's phosphate at pH 7.5

[4]6.0% dilution in distilled water; interfacial tension against cyclohexane

[5]Discharge Duration, sec. - time to discharge aerosol completely at 70° F (21.1° C); Foam Volume, liters - total foam volume immediately after discharge; Control Time, sec. - time at which fire is secrued, although still burning; Extinguishing Time, sec. - time for total extinguishmemt

[6]2B fire - a 5 ft (.465 sq. meters) area fire

EXAMPLE 81

An AFFF agent having a composition as shown for Example 78 and solutions thereof in synthetic sea water were selected to show the low or non-corrosive character of the novel AFFF agents. Corrosion tests carried out in accordance with U.S. Military Requirement MIL-F-24385 Amendment 8, June 20, 1974, show, as presented in Table 20, that corrosion observed with different metals and alloys is much smaller than the maximum tolerance levels specified in MIL-F-24385, Amendment 8.

Table 20

| Property | AFFF Agent Example No. 78 average[1] | maximum | MIL-F-24385 Requirement Amendment 8 (6/20/74) |
|---|---|---|---|
| Corrosion (milligrams/dm day) Partial submersion of metal coupon in liquid for 38 days at 98 F (38 C) | | j | |
| Dilution/Alloy | | | |
| concentrate/cold rolled steel SAE 1010 | 0.77 | 0.83 | 25 maximum |
| concentrate/corrosion resistant steel (CRES 304) | −0103 | 0.12 | 0.5 maximum |
| 6% sea water/cupro-nickel (90% Cu, 10% Ni) | 0.36 | 0.48 | 10 maximum |

[1]Average of 4 tests

EXAMPLES 82 to 84

AFFF agents were formulated containing identical active ingredients but at higher concentrations. The data show that such concentrations can be prepared for 3 percent proportioning with various solvents, or even for 1 percent proportioning. The concentrates are clear and of low viscosity. If sufficient solvent is present they can maintain a foam expansion as high as a 6 percent concentrate. Aer-0-Water 6 and Light Water FC-200 or FC-206 contain so much solvent that they could not be readily formulated as 1 percent proportioning concentrates.

Table 21

| | | Formulation of Highly Concentrated AFFF Agents | | | | | |
|---|---|---|---|---|---|---|---|
| | | 82 3% | | 83 3% | | 84 1% | |
| Example Number Proportioning Type | | % As Is | % Solids | % As Is | % Solids | % As Is | % Solids |
| Anionic $R_f$-Surfactant | A1 | 8.66 | 3.03 | 8.66 | 3.03 | 25.98 | 9.09 |
| $R_f$-Synergist | B1 | 1.38 | 0.69 | 1.38 | 0.69 | 4.14 | 2.07 |
| Ionic Cosurfactant | C1 | 9.34 | 2.80 | 9.34 | 2.80 | 28.02 | 8.40 |
| Other Ionic Cosurfactant | C4 | 5.84 | 2.80 | 5.84 | 2.80 | 17.52 | 8.40 |
| Nonionic Cosurfactant | D1 | 1.50 | 1.50 | 1.50 | 1.50 | 4.50 | 4.50 |
| Solvent | Variable | 6.50(E1) | — | 15.00(E4) | — | — | — |
| Magnesium Sulfate Heptahydrate | | 1.12 | 0.54 | 1.12 | 0.54 | 3.36 | 1.62 |
| Water | | 65.66 | — | 57.16 | — | 16.48 | — |
| pH | | 7.2 | | 7.3 | | 7.2 | |
| Foam Expansion[1,2] | | 4.8 | | 5.6 | | 3.1 | |
| Viscosity (cs) at 77° F | | 2.6 | | 3.8 | | 18.1 | |

[1]Proportioned as specified in tap water
[2]Relative values

EXAMPLES 85 to 113

Table 22 shows how Examples 85 to 113 can be prepared in a similar fashion to earlier examples. These AFFF compositions will also perform effectively as fire extinguishing agents in the context of this patent.

Table 22

| | Other Effective AFFF Agent Compositions | | | | | |
|---|---|---|---|---|---|---|
| Example | Components of Type | | | | | |
| Number | A | B | C | D | E | F |
| 85 | A11 | B11 | C23 | D1 | E4 | $MgSO_4 \cdot 7H_2O$ |
| 86 | A14 | B16 | C22 | ↓ | ↓ | ↓ |
| 87 | A15 | B6 | C1 | ↓ | ↓ | ↓ |
| 88 | A16 | ↓ | ↓ | ↓ | ↓ | ↓ |
| 89 | A17 | ↓ | ↓ | ↓ | ↓ | ↓ |
| 90 | A18 | ↓ | ↓ | ↓ | ↓ | ↓ |
| 91 | A19 | ↓ | ↓ | ↓ | ↓ | ↓ |
| 92 | A20 | ↓ | ↓ | ↓ | ↓ | ↓ |
| 93 | A21 | ↓ | ↓ | ↓ | ↓ | ↓ |
| 94 | A22 | ↓ | ↓ | ↓ | ↓ | ↓ |
| 95 | A24 | ↓ | ↓ | ↓ | ↓ | ↓ |
| 96 | A25 | ↓ | ↓ | ↓ | ↓ | ↓ |
| 97 | A26 | ↓ | ↓ | ↓ | ↓ | ↓ |
| 98 | A27 | ↓ | ↓ | ↓ | ↓ | ↓ |
| 99 | A28 | ↓ | ↓ | ↓ | ↓ | ↓ |
| 100 | A29 | ↓ | ↓ | ↓ | ↓ | ↓ |
| 101 | A30 | ↓ | ↓ | ↓ | ↓ | ↓ |
| 102 | A31 | ↓ | ↓ | ↓ | ↓ | ↓ |
| 103 | A32 | ↓ | ↓ | ↓ | ↓ | ↓ |
| 104 | A33 | ↓ | ↓ | ↓ | ↓ | ↓ |
| 105 | A34 | ↓ | ↓ | ↓ | ↓ | ↓ |
| 106 | A35 | ↓ | ↓ | ↓ | ↓ | ↓ |
| 107 | A36 | ↓ | ↓ | ↓ | ↓ | ↓ |
| 108 | A37 | ↓ | ↓ | ↓ | ↓ | ↓ |
| 109 | A38 | ↓ | ↓ | ↓ | ↓ | ↓ |
| 110 | A39 | ↓ | ↓ | ↓ | ↓ | ↓ |
| 111 | A40 | ↓ | ↓ | ↓ | ↓ | ↓ |
| 112 | A41 | ↓ | ↓ | ↓ | ↓ | ↓ |
| 113 | A42 | ↓ | ↓ | ↓ | ↓ | ↓ |

What is claimed is:

1. An aqueous film forming concentrate composition for extinguishing or preventing fires by suppressing the vaporization of flammable liquids, said composition comprising A. 0.5 to 25% by weight of a fluorinated surfactant of the formula

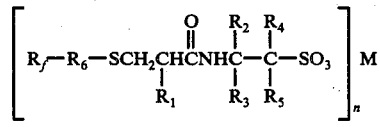

where $R_f$ is straight or branched chain perfluoroalkyl of 1 to 18 carbon atoms or perfluoroalkyl substituted by perfluoroalkoxy of 2 to 6 carbon atom; $R_1$ is hydrogen or lower alkyl; each of $R_2$, $R_4$, and $R_5$, is individually hydrogen or alkyl group of 1–12 carbons; $R_3$ is hydrogen, alkyl of 1 to 12 carbons, phenyl tolyl, and pyridyl; $R_6$ is branched or straight chain alkylene of 1 to 12 carbon atoms, alkylenethioalkylene of 2 to 12 carbon atoms, alkyleneoxyalkylene of 2 to 12 carbon atoms or alkyleneiminoalkylene of 2 to 12 carbon atoms where the nitrogen atom is secondary or tertiary; M is hydrogen, a monovalent alkali metal, an alkaline earth metal, an organic base or ammonium; and $n$ is an integer corresponding to the valency of M;

B. 0.1 to 5% by weight of a fluorinated synergist of the formula $$R_f - T_m - Z$$

where $R_f$ is as defined above; R is $R_6$ or $-R_6SCH_2CHR_1-$, $m$ is an integer 0 or 1, Z is one or more covalently bonded groups selected from $-CONR_1R_2$, $-CN$, $-CONR_1COR_2$, $SO_2NR_1R_2$, $-SO_2NR_1R_7(OH)_n$, $-R_7(OH)_m$, $-R_7(O_2CR_1)_n$, $-CO_2R_1$, $-C(=NH)NR_1R_2$ where $R_1$, $R_2$ and $R_6$ are as defined above and $R_7$ is a branched or straight chain alkylene of 1 to 12 carbon atoms, containing one or more polar groups;

C. 0.1 to 25% by weight of an ionic non-fluorochemical surfactant selected from 1. an anionic surfactant of the formula $$(R_6-SCH_2CHR_1CONHCR_2R_3CR_4R_5SO_3)_mM$$

2. the amphoteric surfactant selected from
   a. organic compounds containing amino and carboxy groups, and
   b. organic compounds containing amino and sulfo groups;

D. 0.1 to 40% by weight of nonionic nonfluorochemical surfactant, selected from polyoxyethylene derivatives of alkyl-phenols, linear or branched alcohols, fatty acids, mercaptans, alkylamines, alkylamides, acetylenic glycols, phosphorus compounds, glucosides, fats and oils, amine oxides, phosphine oxides those derived from block polymers containing polyoxyethylene or polyoxypropylene units, E. 0 to 70% by weight of a solvent selected from an alcohol or an ether, F. 0 to 5% by weight of an electrolyte which is a salt of an alkaline earth metal.

2. A composition of claim 1 wherein in the fluorinated synergist

B. the group T is $—R_6SCH_2CH_2R_1—$, *m* is 1 and Z is $—COONR_1R_2$;

C. the ionic non-fluorochemical surfactant is $C_{12}H_{25}{}^{+}NH\ (CH_2CH_2CO_2{}^{31})CH_2CH_2CO_2H_a$;

D. the nonionic hydrocarbon surfactant is a polyoxyethylene derivative of alkylphenol or a linear or branched alcohol;

E. the solvent is selected from 1-butoxyethoxy-2-propanol, hexylene glycol and diethylene glycol monobutyl ether; and F. the electrolyte is magnesium sulfate.

3. A composition of claim 2 where c. the ionic non-fluorochemical surfactant contains additionally an amino alkylamido sulfonic acid salt of the formula

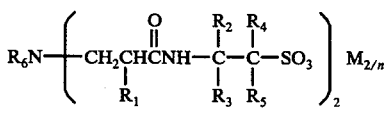

wherein $R_1$ is hydrogen or lower alkyl.

$R_2$, $R_4$ and $R_5$ are independently hydrogen or alkyl group of 1 to 12 carbons, $R_3$ is hydrogen, alkyl of 1 to 12 carbons, phenyl, tolyl, or pyridyl, $R_6$ is a straight or branched chain alkyl of 1 to 25 carbons, substituted alkyl, cycloalkyl of 3 to 8 carbons, alkyl substituted cycloalkyl, furfuryl, morpholinyl, tertalkylamino or a linking group derived from a polyvalent amine, and M is hydrogen, a monovalent alkali metal, an alkaline earth metal or a group derived from an organic base, and

*n* is an integer corresponding to the valency of M.

4. A composition of claim 2 where c. the ionic non-fluorochemical surfactant is

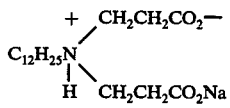

5. A composition of claim 4 where c. the ionic non-fluorochemical surfactant contains additionally an amino alkylamido sulfonic acid salt of the formula

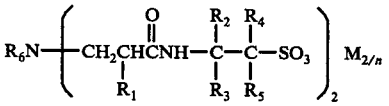

wherein $R_1$ is hydrogen or lower alkyl.

$R_2$, $R_4$ and $R_5$ are independently hydrogen or alkyl group of 1 to 12 carbons, $R_3$ is hydrogen, alkyl of 1 to 12 carbons, phenyl, tolyl, or pyridyl, $R_6$ is a straight or branched chain alkyl of 1 to 25 carbons, substituted alkyl, cycloalkyl of 3 to 8 carbons, alkyl substituted cycloalkyl, furfuryl, morpholinyl, tertalkylamino or a linking group derived from a polyvalent amine, and M is hydrogen, a monovalent alkali metal, an alkaline earth metal or a group derived from an organic base, and

*n* is an integer corresponding to the valency of M.

6. A composition of claim 1 where the amounts of the components are

A. 3 to 25% of a fluorinated surfactant,

B. 0.5 to 5% of a fluorinated synergist,

C. 0.5 to 25% of an ionic non-fluorinated surfactant,

D. 0.5 to 25% of a nonionic non-fluorochemical surfactant,

E. 5 to 50% of a solvent,

F. 0.1 to 5% of an electrolyte, and

G. water in the amount to make up the balance of 100%.

7. A composition of claim 1 which is a concentrate useful in a 6% proportioning system comprising A. 1 to 3.5% by weight of fluorinated surfactant, B. 0.1 to 2.0% by weight of fluorinated synergist, C. 0.1 to 5.0% by weight of ionic non-fluorochemical surfactant, D. 0.1 to 4.0% by weight of nonionic hydrocarbon surfactant, E. 0 to 25.0% by weight of solvent, F. 0 to 2.0% by weight of electrolyte, and G. water in the amount to make up the balance of 100%.

8. A composition of claim 7 comprising

A. 4.45% 2-methyl-2-(3-[1,1,2,2-tetrahydroperfluoroalkylthio] -propionamide)-1-propanesulfonic acid sodium salt, B. 0.72% 3-(1,1,2,2-tetrahydroperfluoroalkylthio) propionamide C. 5.67% partial sodium salt of N-alkyl$\beta$-iminodipropionic acid (30%)

D. 0.75% octylphenoxypolyethoxyethanol

E. 6.5% 1-butoxyehoxy-2-propanol

F. 0.6% magnesium sulfate heptahydrate, and

G. balance of water.

9. A composition of claim 7 comprising

A. 4.45% 2-methyl-2-(3-[1,1,2,2-tetrahydroperfluoroalkylthio] propionamide)-1-propanesulfonic acid sodium salt, B. 0.72% 3-(1,1,2,2-tetrahydroperfluoralkylthio) propionamide C. 5.67% partial sodium salt of N-alkyl$\beta$-iminodipropionic acid (30%)

D. 0.75% octylphenoxypolyethoxyethanol

E. 6.5% 1-butoxyehoxy-2-propanol 9.0% of 2-methyl-2,4-pentanediol

F. 0.6% of magnesium sulfate heptahydrate

G. balance of water.

10. A composition of claim 7 comprising

A. 4.45% 2methyl-2-(3-[1,1,2,2-tetrahydroperfluoroalkylthio] propionamide)-1-propanesulfonic acid sodium salt, B. 0.72% 3-(1,1,2,2-tetrahydroperfluoroalkylthio) propionamide C. 4.47% partial sodium salt of N-alkyl β-iminodipropionic acid 30% 2.82% of disodium salt of N-alkyl-N,N-bis(2-propionamide-2-methyl-1-propane sulfonate D. 0.75% of octylphenoxypolyethoxy ethanol E. 6.5% 1-butoxythoxy-2-propanol F. 0.6% of magnesium sulfate heptahydrate, and G. balance of water.

* * * * *